US011060724B2

(12) United States Patent
Huang et al.

(10) Patent No.: US 11,060,724 B2
(45) Date of Patent: Jul. 13, 2021

(54) GAS APPLIANCE, GAS VALVE AND CONTROL METHOD THEREOF

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 105 days.

(21) Appl. No.: 16/014,174

(22) Filed: Jun. 21, 2018

(65) Prior Publication Data

US 2019/0226678 A1 Jul. 25, 2019

(30) Foreign Application Priority Data

Jan. 25, 2018 (TW) ..... 107102681

(51) Int. Cl.
*F23N 5/18* (2006.01)
*F23N 1/02* (2006.01)
(Continued)

(52) U.S. Cl.
CPC ..... *F23N 5/184* (2013.01); *F23N 1/005* (2013.01); *F23N 1/02* (2013.01); *F23N 5/022* (2013.01);
(Continued)

(58) Field of Classification Search
CPC ..... F23N 5/184; F23N 1/005; F23N 1/002; F23N 5/022; F23N 5/18; F23N 2005/185;
(Continued)

(56) References Cited

U.S. PATENT DOCUMENTS 5,762,880 A 6/1998 Ruhl et al.
6,240,775 B1 * 6/2001 Uramachi ..... G01F 1/6842 73/114.34
(Continued)

FOREIGN PATENT DOCUMENTS

CN 2777389 Y 5/2006
CN 102353806 A 2/2012
(Continued)

OTHER PUBLICATIONS

Examination report for TW107102681, dated Sep. 17, 2018, Total of 14 pages.
(Continued)

*Primary Examiner* — Kelsey E Cary
(74) *Attorney, Agent, or Firm* — Tracy M Heims; Apex Juris, pllc.

(57) ABSTRACT

A gas appliance includes a burner, a gas valve, and a control device, wherein the gas valve includes a valve body, a flow regulator, a hot film anemometer, and a stepper motor. The valve body communicates with the burner and a gas source. The flow regulator is driven by the stepper motor to change a gas flow rate supplying to the burner. The hot film anemometer is disposed in the valve body and includes a probe exposed to the outlet passage. The control device executes a control method for the gas valve: sensing the gas flow rate in the outlet passage with the hot film anemometer; comparing the gas flow rate sensed by the hot film anemometer with a predetermined gas flow rate, and controlling the stepper motor to drive the flow regulator based on the comparison result, whereby to stabilize the gas flow rate.

17 Claims, 9 Drawing Sheets

(51) Int. Cl.
*F23N 5/02* (2006.01)
*F23N 1/00* (2006.01)

(52) U.S. Cl.
CPC ..... *F23N 5/18* (2013.01); *F23N 2005/185* (2013.01); *F23N 2225/14* (2020.01); *F23N 2235/10* (2020.01); *F23N 2235/16* (2020.01); *F23N 2235/24* (2020.01)

(58) Field of Classification Search
CPC ..... F23N 2005/181; F23N 5/265; F23N 2225/14; F23N 2235/10; F23N 2235/16; F23N 2235/24; F16K 27/0236
USPC ..... 251/209
See application file for complete search history.

(56) References Cited

U.S. PATENT DOCUMENTS

| | | | | |
|---|---|---|---|---|
| 6,557,409 | B2 | 5/2003 | Setescak | |
| 6,561,791 | B1 * | 5/2003 | Vrolijk | F23N 1/022 431/12 |
| 2001/0052263 | A1 * | 12/2001 | Setescak | F02D 41/187 73/204.21 |
| 2010/0170483 | A1 * | 7/2010 | Wienand | G01F 1/6842 123/568.12 |
| 2014/0230925 | A1 * | 8/2014 | Halimi | G05D 16/20 137/487.5 |
| 2014/0358301 | A1 * | 12/2014 | Muir | G05D 16/2095 700/282 |
| 2015/0107710 | A1 * | 4/2015 | Huang | F16K 37/005 137/859 |
| 2017/0059170 | A1 | 3/2017 | Huang et al. | |
| 2018/0274958 | A1 * | 9/2018 | Critchley | G01F 1/684 |

FOREIGN PATENT DOCUMENTS

| | | | |
|---|---|---|---|
| CN | 102954500 | A | 3/2013 |
| CN | 103867765 | A | 6/2014 |
| CN | 104024738 | A | 9/2014 |
| CN | 104136894 | A | 11/2014 |
| CN | 104633131 | A | 5/2015 |
| CN | 105402766 | A | 3/2016 |
| CN | 106641310 | A | 5/2017 |
| CN | 208041252 | U | 11/2018 |
| EP | 0064560 | A1 | 11/1982 |
| EP | 2589868 | A1 | 5/2013 |
| TW | I348532 | B | 9/2011 |

OTHER PUBLICATIONS

Search report for TW107102681, dated Sep. 17, 2018, Total of 1 page.
English Abstract for CN2777389, Total of 1 page.
English Abstract for CN104024738, Total of 1 page.
English Abstract for CN104136894, Total of 1 page.
English Abstract for TWI348532, Total of 1 page.
Jun-Ping Huang, Qiche Fadongji Jiance Yu Weixiu, Aug. 2010, 15 pages, Huazhong University of Science & Technology Press, Wuhan City, China.
Chinese Office Action for CN201810228986.6, dated May 12, 2020, Total of 11 pages.
Extended European search report for EP18180056.6, dated Dec. 6, 2018, Total of 7 pages.
English abstract for CN102353806, Total of 1 page.
English abstract for CN102954500, Total of 1 page.
English abstract for CN103867765, Total of 1 page.
English abstract for CN104633131, Total of 1 page.
English abstract for CN105402766, Total of 1 page.
English abstract for CN106641310, Total of 1 page.
English abstract for CN208041252, Total of 1 page.
English abstract for EP2589868, Total of 1 page.
English abstract for Qiche Fadongji Jiance Yu Weixiu, Total of 1 page.

* cited by examiner

GAS APPLIANCE, GAS VALVE AND CONTROL METHOD THEREOF

BACKGROUND OF THE INVENTION

Technical Field

The present invention is related to a gas appliance, and more particularly to a gas appliance, a gas valve, and a control method thereof, which could stabilize a gas flow rate.

Description of Related Art

Gas appliances are usually utilized as heating devices. As comparing to electro-thermal heating devices, the gas appliances provide more heat energy by burning gas. In addition, the gas appliances also have a heating time and a response time which are faster than the electro-thermal heating devices.

Referring to FIG. 1, a conventional gas appliance 1 includes a burner 10, a gas valve 12, and a pressure regulator 14, wherein the burner 10 is adapted to burn gas to generate flames; the gas valve 12 communicates with the burner 10 and is adapted to regulate a gas flow rate supplying to the burner 10 manually or automatically; one end of the pressure regulator 14 is connected to the gas valve 12, and another end of the pressure regulator 14 is connected to a gas source 16 (e.g. liquefied petroleum gas or natural gas).

It is required for the conventional gas appliance 1 to utilize the pressure regulator 14 to stabilize a pressure output from the gas source 16 to the gas valve 12. However, when the pressure output from the gas source 16 is smaller than a certain pressure, the pressure output from the pressure regulator 14 would be unstable. Since the gas valve 12 is adapted to regulate the gas flow rate by changing an opening degree of an opening, the gas flow rate would be unstable when the pressure supplying to the gas valve 12 is unstable, thereby affecting the combustion efficiency of the burner 10.

BRIEF SUMMARY OF THE INVENTION

In view of the above, an object of the present invention is to provide a gas appliance, a gas valve, and a control method thereof, which could stabilize a gas flow rate.

To achieve the object mentioned above, the present invention provides a gas valve including a valve body, a flow regulator, a hot film anemometer, and a driver, wherein the valve body includes an air inlet, an air outlet, an inlet passage communicating with the air inlet, an outlet passage communicating with the air outlet, and an opening disposed between the inlet passage and the outlet passage; the flow regulator is movably disposed at the opening of the valve body and is driven to change an opening degree of the opening; the hot film anemometer is disposed in the valve body and includes a probe which includes a hot film resistor exposed to the outlet passage to sense a gas flow rate passing through the outlet passage; the driver is disposed in the valve body and connected to the flow regulator, and is adapted to receive a control signal to drive the flow regulator to move.

The present invention provides a control method for the gas valve, wherein the air inlet is adapted to be connected to a gas source, and the air outlet communicates with a burner; the control method comprises steps of: controlling the driver to drive the flow regulator to open the opening; sensing the gas flow rate in the outlet passage with the hot film anemometer; comparing the gas flow rate sensed by the hot film anemometer with a predetermined gas flow rate, and controlling the driver to drive the flow regulator based on the comparison result, thereby enabling the gas flow rate sensed by the hot film anemometer to be maintained at the predetermined gas flow rate.

The present invention provides a gas appliance including a burner, a gas valve, and a control device, wherein the burner is adapted to burn gas to generate flames; the gas valve includes a valve body, a flow regulator, a hot film anemometer, and a driver, wherein the valve body includes an air inlet, an air outlet, an inlet passage communicating with the air inlet, an outlet passage communicating with the air outlet, and an opening disposed between the inlet passage and the outlet passage; the air inlet is adapted to be connected to a gas source, and the air outlet communicates with the burner; the flow regulator is movably disposed at the opening of the valve body and is driven to change an opening degree of the opening; the hot film anemometer is disposed in the valve body and includes a probe which includes a hot film resistor exposed to the outlet passage to sense a gas flow rate passing through the outlet passage; the driver is disposed in the valve body and connected to the flow regulator, and is adapted to receive a control signal to drive the flow regulator to move; the control device is electronically connected to the hot film anemometer and the driver and adapted to control the driver to drive the flow regulator by outputting the control signal according to a predetermined gas flow rate, thereby enabling the gas flow rate sensed by the hot film anemometer to be maintained at the predetermined gas flow rate.

The advantage of the present invention is that a variation of the gas flow rate could be sensed accurately and rapidly by disposing the hot film anemometer in the outlet passage, whereby to control the stepper motor and stabilize the gas flow rate passing through the gas valve without disposing the pressure regulator. In this way, the gas flow rate could be controlled more accurately and the manufacturing cost of the gas appliance could be reduced.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
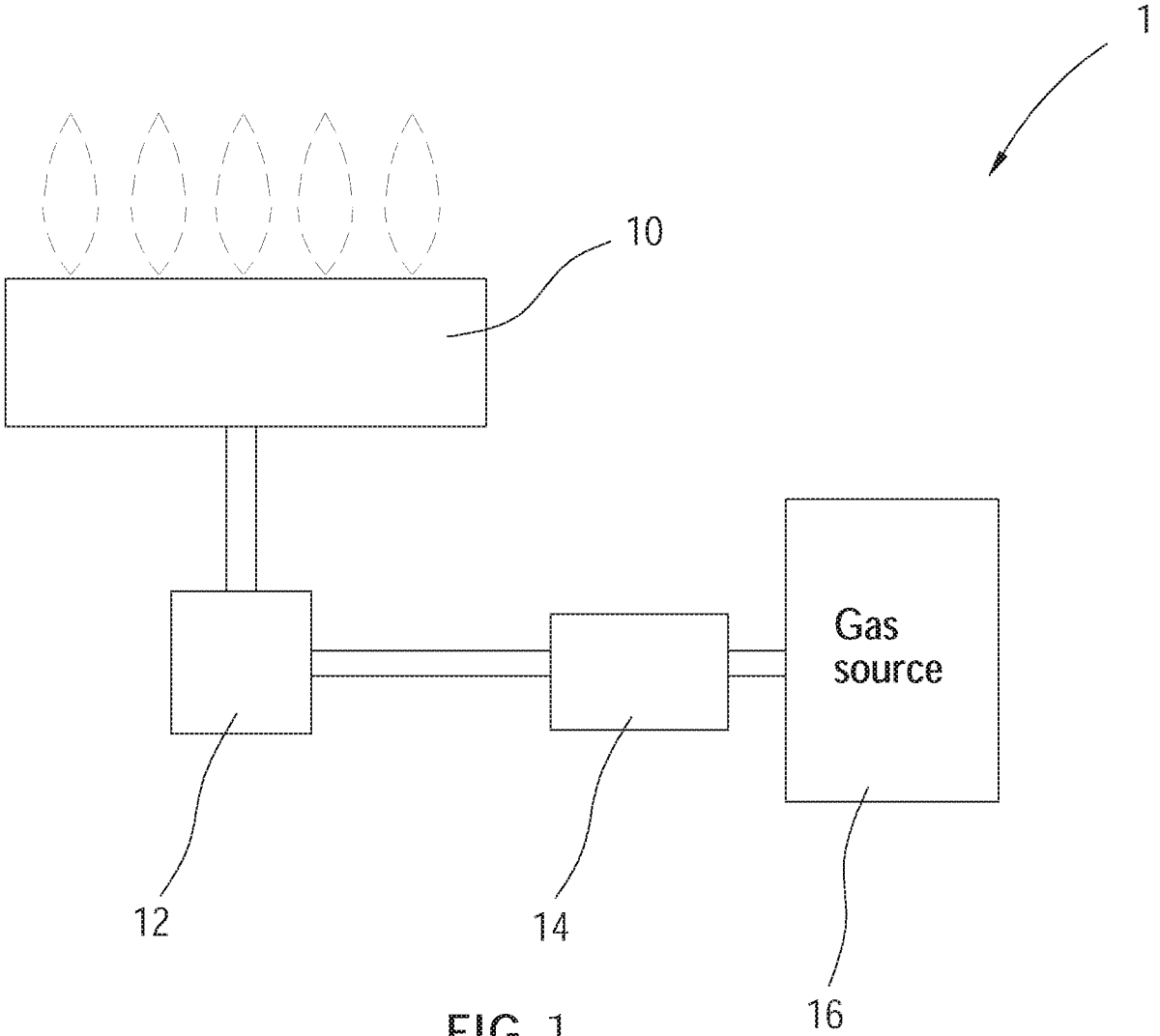
FIG. 1 (PRIOR ART)
FIG. 1 is a schematic view showing a conventional gas appliance.
Figure 2:
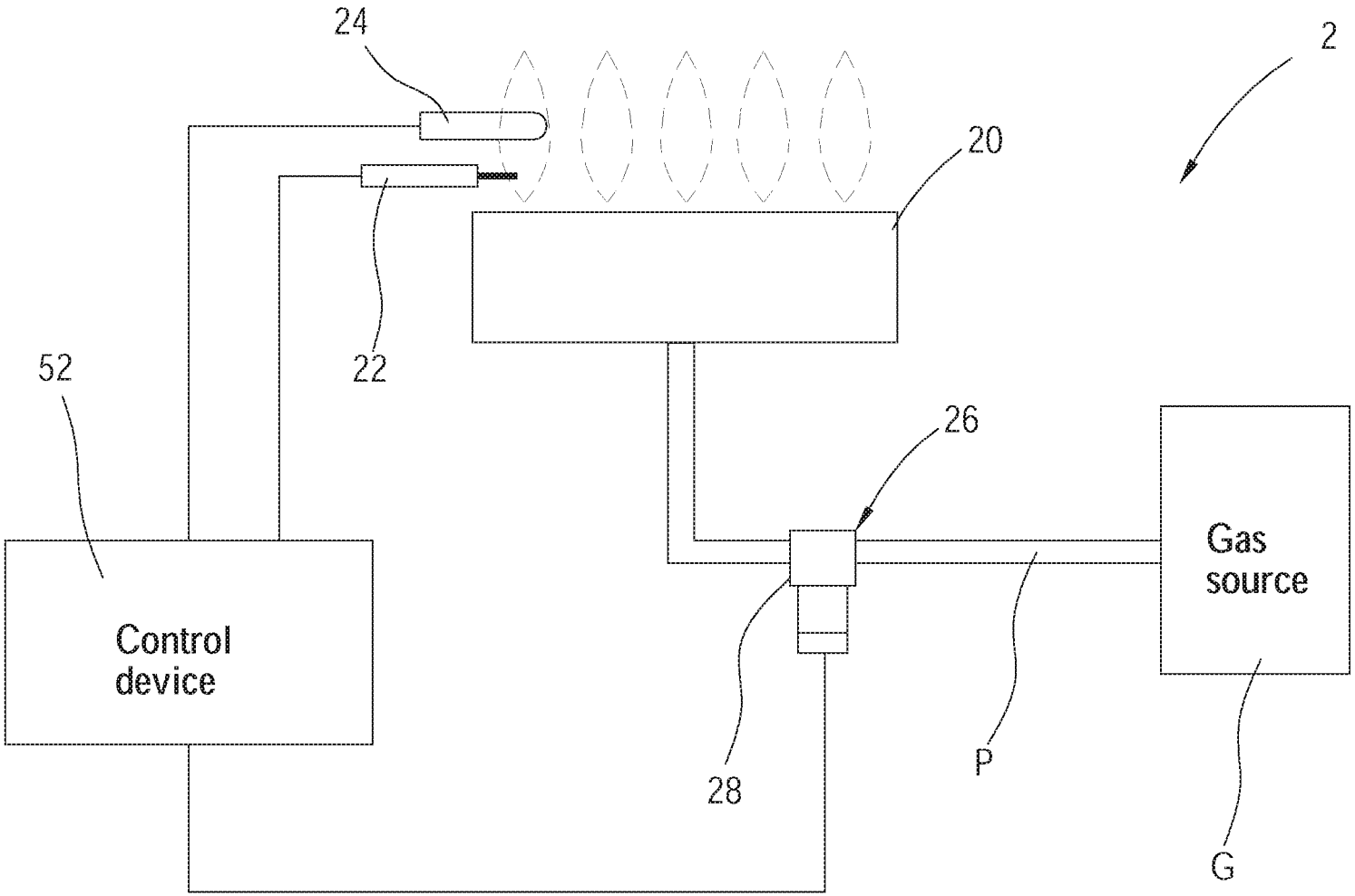
FIG. 2 is a schematic view showing a gas appliance of a first embodiment according to the present invention.

The following illustrative embodiments and drawings are provided to illustrate the disclosure of the present invention, these and other advantages and effects can be clearly understood by persons skilled in the art after reading the disclosure of this specification. As shown in FIG. 2 to FIG. 5, a gas appliance 2 of a first embodiment according to the present invention includes a burner 20, an ignitor 22, a flame detector 24, a gas valve 26, and a control device 52. In this embodiment, the gas appliance 2 could be a gas heating device such as a gas stove, a fireplace, or a water heater for example.

The burner 20 is adapted to burn gas to generate flames. The ignitor 22 is disposed adjacent to the burner 20 and is controllable to generate sparks with respect to the burner 20 so as to ignite the gas output from the burner 20. The flame detector 24 is disposed adjacent to the burner 20 to detect the flames. The flame detector 24 could be a thermocouple or a flame sensor as an example.

The gas valve 26 is disposed on a gas pipe P which communicates with the burner 20. The gas valve 26 is controllable to open and block the gas pipe P and regulate the gas flow rate supplying to the burner 20. In this embodiment, the gas valve 26 includes a valve body 28, a flow regulator 34, a hot film anemometer 38, and a driver which is a stepper motor 50 as an example. Wherein, the valve body 28 includes an air inlet 301, an air outlet 324, an inlet passage 303 communicating with the air inlet 301, an outlet passage 322 communicating with the air outlet 324, and an opening 304 disposed between the inlet passage 303 and the outlet passage 322. Wherein, the air inlet 301 is adapted to be connected to a gas source G, and the air outlet 324 communicates with the burner 20. In this embodiment, the air inlet 301 directly communicates with the gas source G via the gas pipe P, and there is no pressure regulator 14, which is used in a conventional gas appliance, disposed between the air inlet 301 and the gas source G.

In this embodiment, the valve body 28 includes a main body 30 and a tube 32, wherein the main body 30 includes the air inlet 301, the inlet passage 303, the opening 304, and a connecting passage 305; the opening 304 is disposed between the inlet passage 303 and the connecting passage 305. The tube 32 is connected to the connecting passage 305 and includes the outlet passage 322 and the air outlet 324. The outlet passage 322 includes a first section 322*a*, a second section 322*b*, and a third section 322*c*, wherein the first section 322*a* is between the second section 322*b* and the third section 322*c*. The first section 322*a* is tapered and has an internal diameter which is gradually decreased in a direction from the third section 322*c* to the second section 322*b*; the second section 322*b* is equal-diameter and is between the first section 322*a* and the air outlet 324.

The connecting passage 305 has an internal thread. The tube 30 includes a threaded tube 32*a* and an outer tube 32*b* which are connected to each other, wherein the threaded tube 32*a* is engaged with the internal thread of the connecting passage 305; the outer tube 32*b* includes at least a part of the second section 322*b* and is disposed outside of the main body 30. The hot film anemometer 38 is disposed in the outer tube 32*b*. More specifically, the outer tube 32*b* includes a recess 326 which is recessed from a wall of the second section 322*b*. In this embodiment, the outer tube 32*b* forms a head which is a hexagon head as an example, and the head is rotatable such that the threaded tube 32*a* could be screwed to the connecting passage 305. A seal ring is disposed between the outer tube 32*b* and the main body 30 to prevent the gas from leaking out.

The flow regulator 34 is movably disposed at the opening 304 of the valve body 28. In this embodiment, the flow regulator 34 is a valve plug as an example, and is connected to a transmission mechanism 36, wherein the transmission mechanism 36 is driven to change an opening degree of the opening 304.

Figure 3:
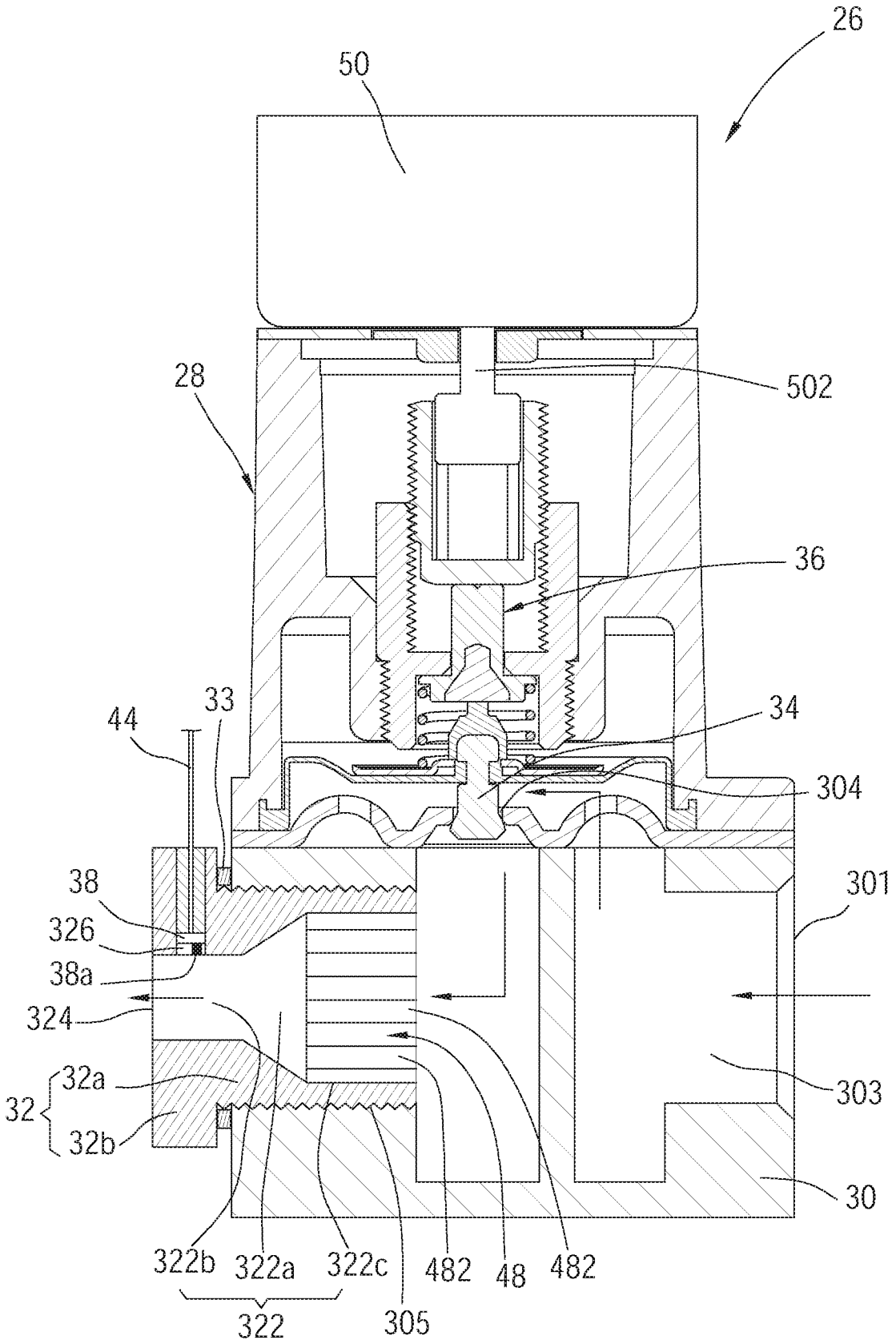
FIG. 3 is a schematic view showing the gas valve of the gas appliance of FIG. 2.
Figure 4:
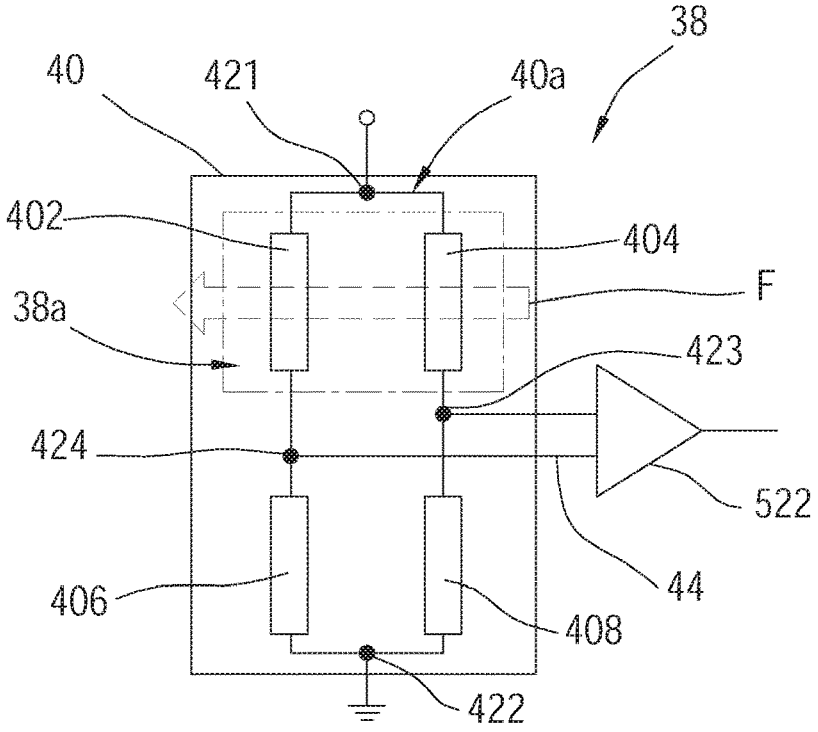
FIG. 4 is a schematic view showing the hot film anemometer of the gas appliance of FIG. 2.

Referring to FIG. 3 and FIG. 4, the hot film anemometer 38 is disposed in the valve body 28. The hot film anemometer 38 includes a probe 38*a* exposed to the outlet passage 322 to sense the gas flow rate passing through the outlet passage 322. In this embodiment, the hot film anemometer 38 includes a substrate 40, and a hot film resistor 402 and a compensation resistor 404 which are disposed on the substrate 40, wherein the hot film resistor 402 and the compensation resistor 404 are exposed to the outlet passage 322. The probe 38*a* includes the hot film resistor 402 and the compensation resistor 404, and a resistance of the hot film resistor 402 is smaller than a resistance of the compensation resistor 404.

In practice, the probe 38*a* could only include the hot film resistor 402 exposed to the outlet passage 322. In this embodiment, the hot film anemometer 38 is disposed in the recess 326, and the probe 38*a* of the hot film anemometer 38 is exposed to the second section 322*b*, wherein the hot film anemometer 38 does not protrude out of the inner wall of the tube 32. The hot film anemometer 38 is electronically connected to an external circuit via a signal wire 44 extending out of the outer tube 32*b* of the tube 32.

Another two resistors 406, 408 are further disposed on the substrate 40 and form a bridge circuit 40*a* together with the hot film resistor 402 and the compensation resistor 404, wherein each one end of the hot film resistor 402 and the compensation resistor 404 is connected to a first node 421, and the first node 421 is adapted to be connected to a power supply; each one end of the another two resistors 406, 408 is connected to a second node 422, and the second node 422 is adapted to be connected to a grounding terminal. When the power is supplied, the hot film resistor 402 would generate heat, and meanwhile, when the gas flow F passing through the hot film resistor 402 increases, the hot film resistor 402 would be cooled down and the resistance thereof would become small and the current thereof would increase. In order to balance the bridge circuit 40*a*, the current of the compensation resistor 404 increases as well, thereby raising the temperature of the hot film resistor 402 again, and vice versa. Whereby, the current of the compensation resistor 404 and the gas flow rate are proportional and corresponding to each other. Hence, the voltage between a third node 423 and a fourth node 424 of the bridge circuit 40*a* would be proportional to the gas flow rate. In this embodiment, the first node 421, the second node 422, the third node 423, and the fourth node 424 are connected to outside of the valve body 28 via the signal wire 44. The third node 423 and the fourth node 424 are connected to an amplifying circuit 522, wherein the amplifying circuit 522 is disposed outside of the valve body 28 and adapted to amplify the voltage between the third node 423 and the fourth node 424. In practice, the amplifying circuit 522 could be disposed on the substrate 40 as well.

Figure 5:
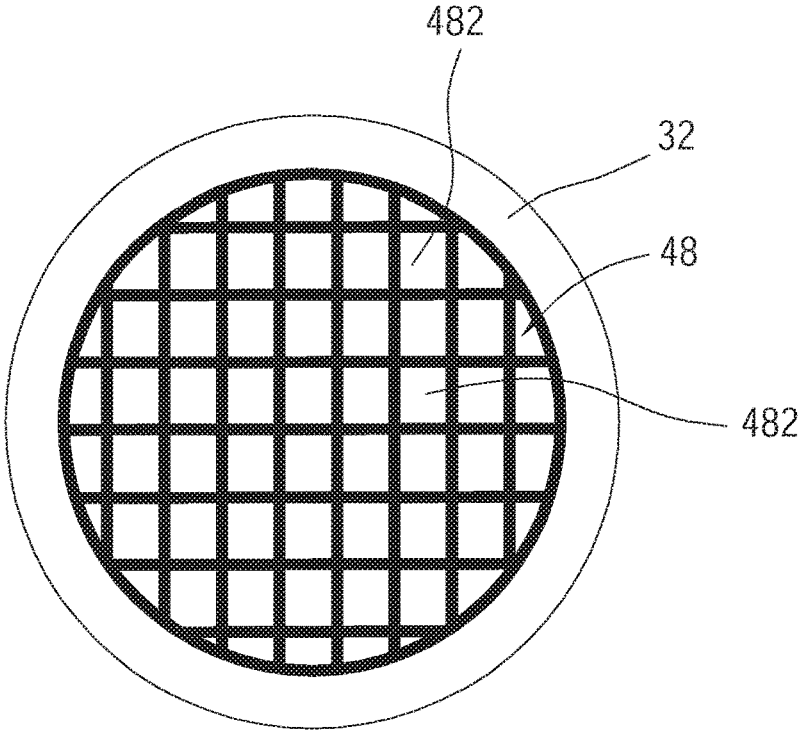
FIG. 5 is a schematic view showing that the flow guiding member is disposed in the tube according to the embodiment of FIG. 2.

In order to sense the gas flow rate more accurately, the gas valve 26 provided by this embodiment further includes a flow guiding member 48. The flow guiding member 48 is disposed in the third section 322*c* of the outlet passage 322 of the tube 32, and the probe 38*a* of the hot film anemometer 38 is disposed between the flow guiding member 48 and the air outlet 324. The flow guiding member 48 includes a plurality of sub-passages 482 (as shown in FIG. 3 and FIG. 5) which could guide the gas flow F to pass through the probe 38*a* fluently, thereby reducing a detection error which is caused by the turbulent flow.

The stepper motor 50 is disposed in the valve body 28 and connected to the flow regulator 34. The stepper motor 50 is adapted to receive a control signal to drive the flow regulator 34 to move. In this embodiment, a rotary shaft 502 of the stepper motor 50 is connected to the flow regulator 34 via the transmission mechanism 36. When the rotary shaft 502 of the stepper motor 50 is rotated clockwise or counter-clockwise, the flow regulator 34 would be driven to move along an axial direction of the rotary shaft 502, thereby changing the opening degree of the opening 304.

The control device 52 is electronically connected to the ignitor 22, the flame detector 24, the hot film anemometer 38, and the stepper motor 50. In this embodiment, the control device 52 includes the power supply and the grounding terminal, and is adapted to supply power to the bridge circuit 40*a* on the substrate 40 of the hot film anemometer 38 via the signal wire 44. The control device 52 further includes the amplifying circuit 522 and is electronically connected to the bridge circuit 40*a* via the signal wire 44 to receive the voltage between the third node 423 and the fourth node 424 of the bridge circuit 40*a*.

The control device 52 is adapted to execute a control method for the gas valve 26 in this embodiment. When the gas appliance 2 is idle (that is, the opening 304 is closed), before executing the control method, the control device 52 would control the ignitor 22 to generate sparks with respect to the burner 10 first.

Figure 6:
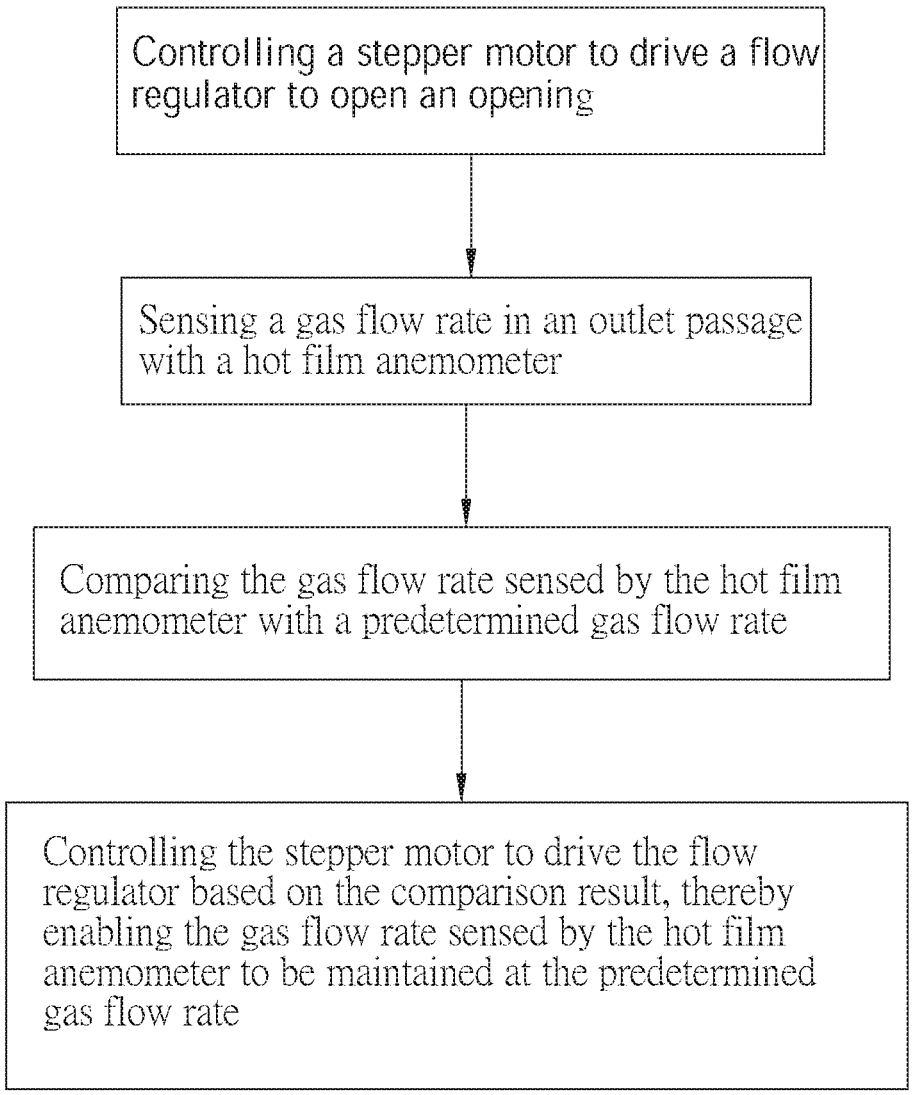
FIG. 6 is a flowchart of a control method for the gas valve of FIG. 2.

Then, the control method for the gas valve 26 is executed, wherein the control method includes the following steps, which are shown in FIG. 6.

The control device 52 outputs the control signal to control the stepper motor 50 to drive the flow regulator 34 to open the opening 304 for passing the gas; when the gas is ignited, the control device 52 would be informed of the ignition via an electrical signal sending back from the flame detector 24.

The hot film anemometer 38 is adapted to sense the gas flow rate in the outlet passage 322; in this embodiment, the control device 52 would convert the voltage output from the bridge circuit 40*a* of the hot film anemometer 38 into a corresponding gas flow rate.

The control device 52 is adapted to control the stepper motor 50 to drive the flow regulator 34 by outputting the control signal based on a predetermined gas flow rate and the gas flow rate sensed by the hot film anemometer 38, thereby enabling the gas flow rate sensed by the hot film anemometer 38 to be maintained at the predetermined gas flow rate. More particularly, the control device 52 would compare the gas flow rate sensed by the hot film anemometer 38 with the predetermined gas flow rate, and control the stepper motor 50 to drive the flow regulator 34 based on the comparison result such that the gas flow rate sensed by the hot film anemometer 38 could be maintained at the predetermined gas flow rate.

In this embodiment, the predetermined gas flow rate is corresponding to a predetermined heating value. When the gas flow rate supplying to the burner 20 is equal to the predetermined gas flow rate, the burner 20 would generate the predetermined heating value.

Whereby, even the pressure output from the gas source G is unstable or too small, resulting in a variation of the gas flow rate, the gas flow rate output from the gas valve 26 still could be stably maintained at the predetermined gas flow rate through controlling the flow regulator 34. The advantage of the hot film anemometer 38 is that the gas flow rate could be sensed rapidly, hence, the stepper motor 50 could be controlled instantly and the gas flow rate could be maintained at the predetermined gas flow rate rapidly. Since the hot film anemometer 38 is disposed between the opening 304 and the air outlet 324, the gas flow rate has been regulated by the flow regulator 34 already and the gas flow rate passing through the hot film anemometer 38 would be more stable.

Figure 7:
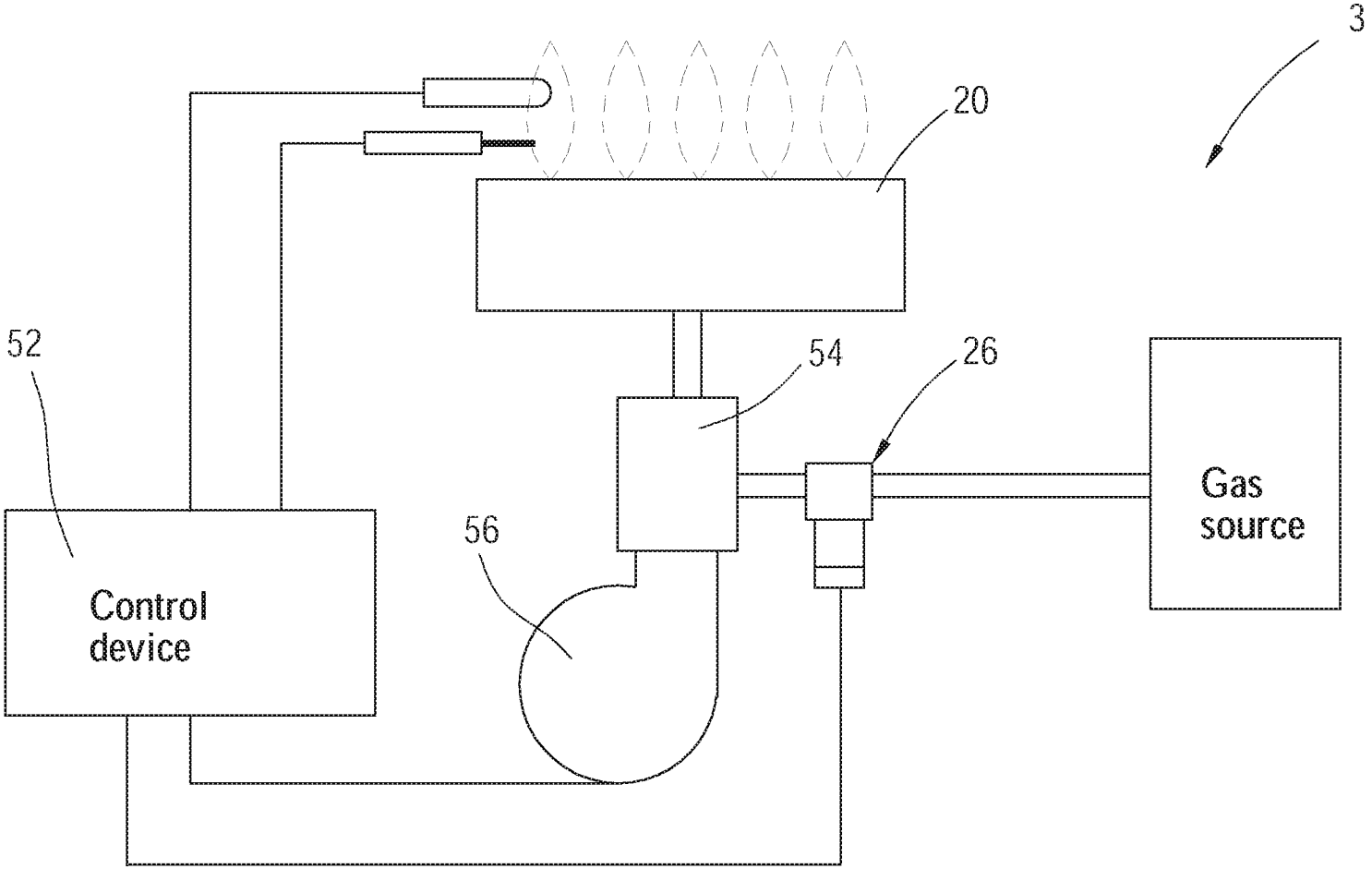
FIG. 7 is a schematic view showing a gas appliance of a second embodiment according to the present invention.

As shown in FIG. 7, a gas appliance of a second embodiment according to the present invention has almost the same structure as the gas appliance of the first embodiment, except that the gas appliance provided by the second embodiment further includes a mixer 54 and a blower 56, wherein the mixer 54 is disposed between the gas valve 26 and the burner 20. The blower 56 is electronically connected to the control device 52 and an air outlet of the blower 56 is connected to the mixer 54. The control device 52 generates a predetermined rotation speed and a predetermined gas flow rate according to a predetermined heating value, wherein the control device 52 controls a rotation speed of a motor of the blower 56 according to the predetermined rotation speed, and controls the stepper motor 50 to drive the flow regulator 34 according to the predetermined gas flow rate and the gas flow rate sensed by the hot film anemometer 38, thereby enabling the gas flow rate sensed by the hot film anemometer 38 to be maintained at the predetermined gas flow rate.

Figure 8:
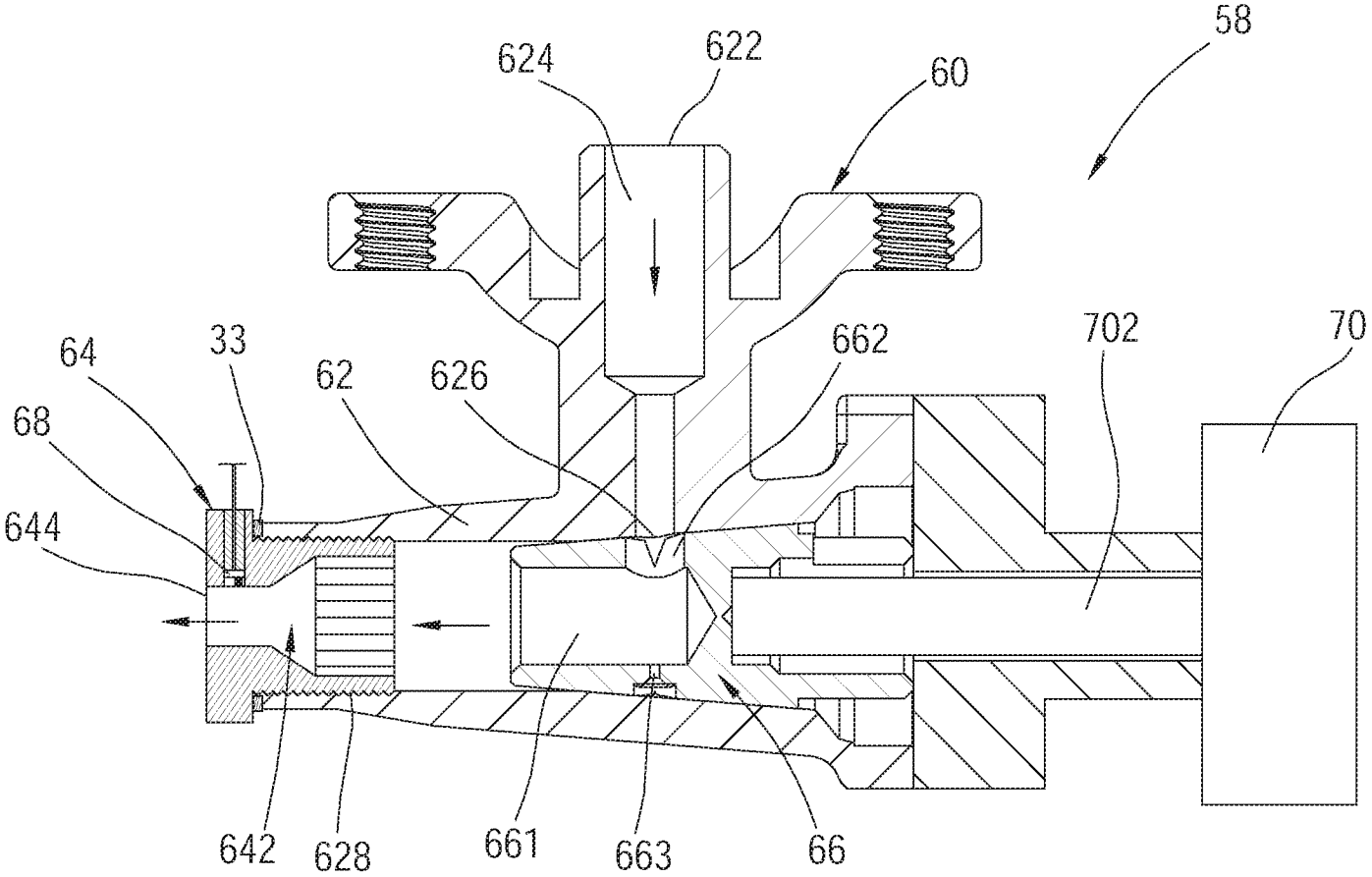
FIG. 8 is a schematic view showing a gas valve of a third embodiment according to the present invention.
Figure 9:
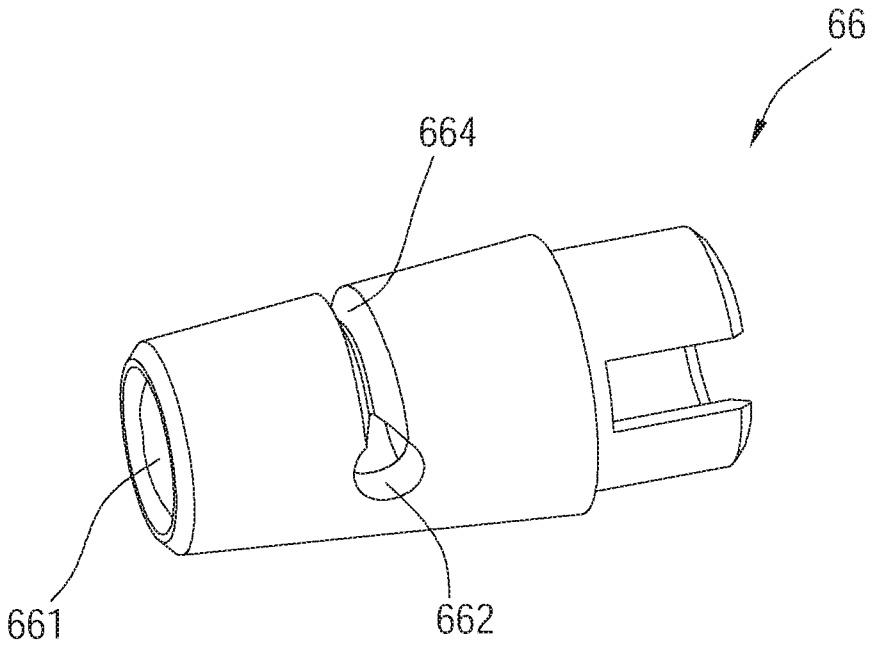
FIG. 9 and FIG. 10 are perspective views of the flow regulator of the third embodiment according to the present invention.
Figure 10:
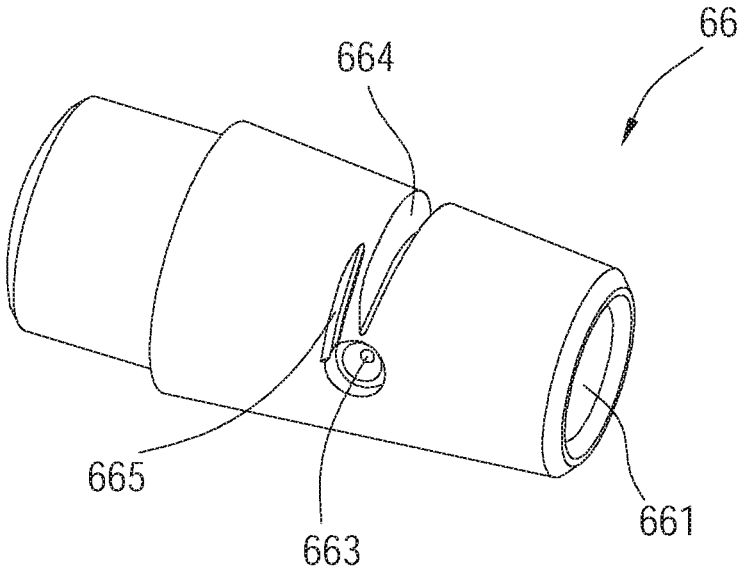

As shown in FIG. 8 to FIG. 10, a gas valve 58 of a third embodiment according to the present invention is illustrated and has a structure similar to the gas valve 26 of the first embodiment. The gas valve 58 includes a valve body 60, a flow regulator 66, a hot film anemometer 68, and a stepper motor 70. The valve body 60 provided by this embodiment includes a main body 62 and a tube 64, wherein the main body 62 includes an air inlet 622, an inlet passage 624, an opening 626, and a connecting passage 628; the tube 64 has the same structure as the tube 32 of the first embodiment, and includes an outlet passage 642 and an air outlet 644. The flow regulator 66 provided by this embodiment is a plug member as an example, and is rotatably disposed in the main body 62. The flow regulator 66 includes an axial hole 661, a first hole 662, a second hole 663, a first guiding groove 664, and a second guiding groove 665, wherein the first hole 662 and the second hole 663 communicate with the axial hole 661, and a diameter of the first hole 662 is greater than a diameter of the second hole 663. The first guiding groove 664 and the second guiding groove 665 are disposed between the first hole 662 and the second hole 663; one end of the first guiding groove 664 is connected to the first hole 662, and one end of the second guiding groove 665 is connected to the second hole 663. In practice, the flow regulator 66 could only include the axial hole 661, the first hole 662, and the first guiding groove 664.

Similar to the first embodiment, the hot film anemometer 68 is disposed in the valve body 60. The stepper motor 70 is disposed with the main body 62, and a rotary shaft 702 of the stepper motor 70 is connected to the plug member. Whereby, the gas valve 58 provided by this embodiment could be adapted to the gas appliance 2 of the first embodiment as well.

Figure 11:
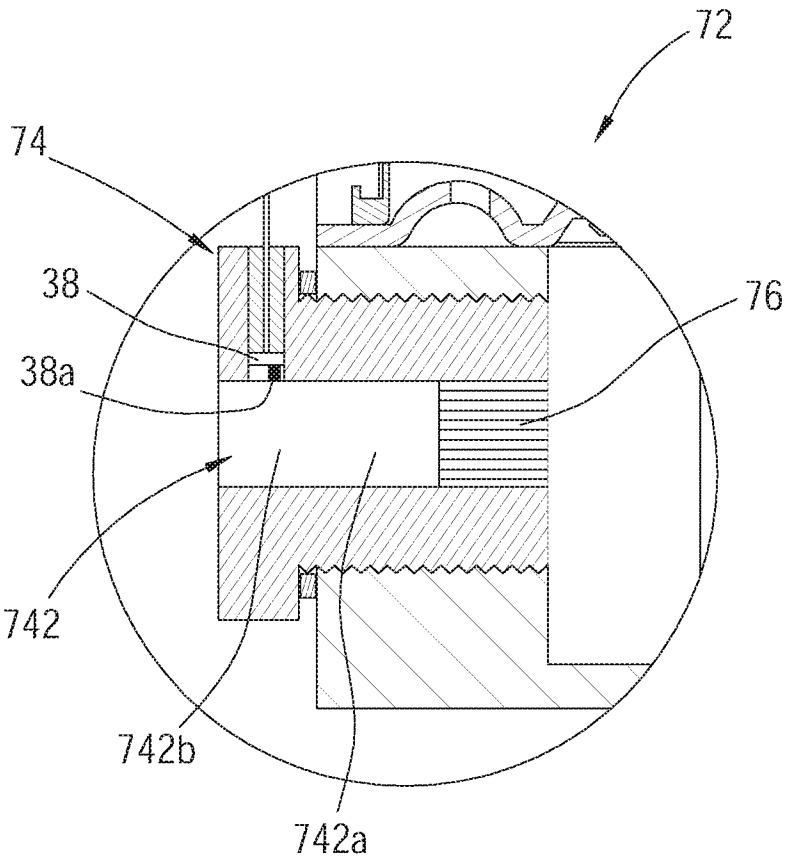
FIG. 11 is a schematic view showing a gas valve of a fourth embodiment according to the present invention.

As shown in FIG. 11, a gas valve 72 of a fourth embodiment according to the present invention has almost the same structure as the gas valve 26 of the first embodiment, except that a first section 742*a* and a second section 742*b* of an outlet passage 742 of a tube 74 have identical internal diameters, that is, the outlet passage 742 between a flow guiding member 76 and the hot film anemometer 38 has an equal internal diameter. Whereby, the gas flow F could pass through the probe 38*a* of the hot film anemometer 38 more stably.

Figure 12:
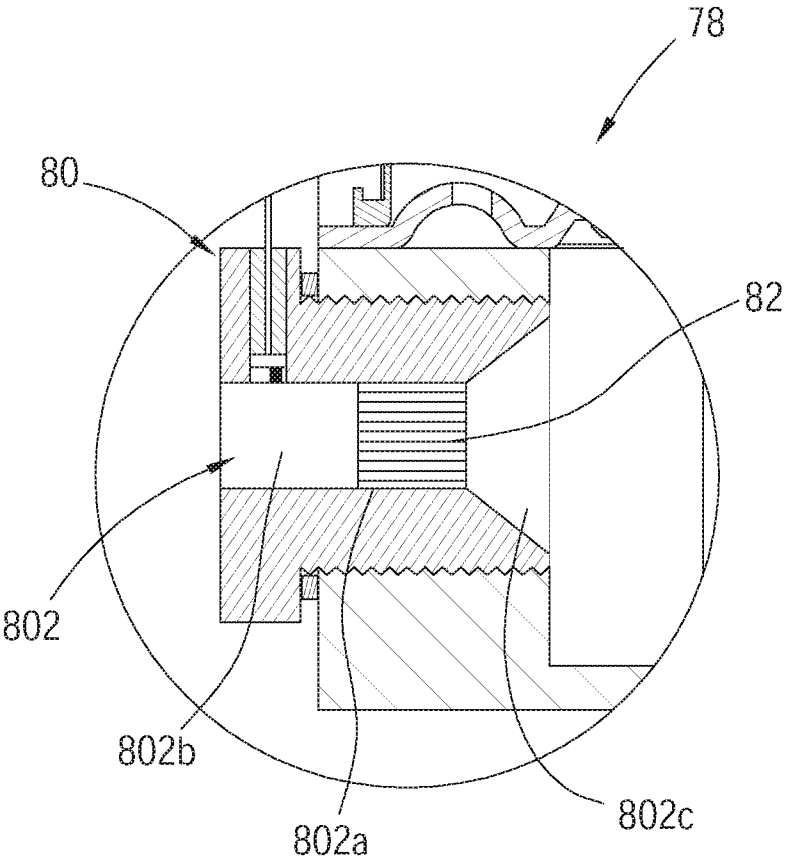
FIG. 12 is a schematic view showing a gas valve of a fifth embodiment according to the present invention.

As shown in FIG. 12, a gas valve 78 of a fifth embodiment according to the present invention has almost the same structure as the gas valve 26 of the first embodiment, except that a first section 802*a* and a second section 802*b* of an outlet passage 802 of a tube 80 have identical internal diameters, while a third section 802*c* is tapered, and a flow guiding member 82 is disposed in the first section 802*a*. The outlet passage 802 between the flow guiding member 82 and the hot film anemometer 38 has an equal internal diameter. Whereby, the gas flow F could pass through the probe 38*a* of the hot film anemometer 38 more stably as well.

The outlet passage 642 of the tube 64 of the third embodiment also could adopt the structures of the tube 74, 80 of the fourth and the fifth embodiments.

The driver of each of the aforementioned embodiments is a stepper motor as an example. In practice, the gas valve could also be a proportional valve as an example, as disclosed in United States patent publication number US20090206291A1. A driver of the proportional valve includes a coil and a magnet, which could drive a flow regulator to change an opening degree of an opening via an electromagnetic force.

According to the illustration mentioned above, the variation of the gas flow rate could be sensed accurately and rapidly by disposing the hot film anemometer in the outlet passage, whereby to control the stepper motor and stabilize the gas flow rate passing through the gas valve without disposing the pressure regulator. In this way, the gas flow rate could be controlled more accurately and the manufacturing cost of the gas appliance could be reduced.

It must be pointed out that the embodiments described above are only some embodiments of the present invention. All equivalent structures which employ the concepts disclosed in this specification and the appended claims should fall within the scope of the present invention.

What is claimed is:

1. A gas valve, comprising:

a valve body, including an air inlet, an air outlet, an inlet passage communicating with the air inlet, an outlet passage communicating with the air outlet, and an opening disposed between the inlet passage and the outlet passage; wherein the valve body comprises a main body and a tube detachably connected to the main body, the tube comprises a threaded tube and an outer tube which are connected to each other; the threaded tube is engaged with an internal thread of a connecting passage of the main body; the tube comprises the outlet passage and the air outlet, and a recess is recessed into an inner wall of the tube;

a flow regulator, being movably disposed at the opening of the valve body, wherein the flow regulator is driven to change an opening degree of the opening;

a hot film anemometer, disposed in the recess of the tube, wherein the hot film anemometer includes a probe which includes a hot film resistor exposed to the outlet passage of the tube to sense a gas flow rate passing through the outlet passage of the tube; wherein a section of a signal wire connected to the hot film anemometer is disposed in the tube, and an end of the signal wire which is not connected to the hot film anemometer extends in a direction away from the outlet passage; and a driver, disposed in the valve body and connected to the flow regulator, wherein the driver is adapted to receive a control signal to drive the flow regulator to move;

wherein the hot film anemometer does not protrude out of the inner wall of the tube.

2. The gas valve of claim 1, wherein the hot film anemometer further includes a substrate, and the hot film resistor is disposed on the substrate.

3. The gas valve of claim 1, further comprising a flow guiding member disposed in the outlet passage; the probe of the hot film anemometer is disposed between the flow guiding member and the air outlet.

4. The gas valve of claim 3, wherein the flow guiding member further includes a plurality of sub-passages.

5. The gas valve of claim 3, wherein the outlet passage further includes a first section and a second section, wherein the first section is between the flow guiding member and the second section, and the second section is between the first section and the air outlet; the probe of the hot film anemometer is disposed in the second section.

6. The gas valve of claim 5, wherein the outer tube includes at least a part of the second section and is disposed outside of the main body; the hot film anemometer is disposed in the outer tube.

7. The gas valve of claim 3, wherein the first section and the second section of the outlet passage have identical internal diameters.

8. The gas valve of claim 6, wherein the recess is located at the outer tube and is recessed into a wall of the second section.

9. A control method for the gas valve of claim 1, wherein the air inlet is adapted to be connected to a gas source, and the air outlet communicates with a burner; the control method comprises steps of:

controlling the driver to drive the flow regulator to open the opening;

sensing the gas flow rate in the outlet passage with the hot film anemometer; and comparing the gas flow rate sensed by the hot film anemometer with a predetermined gas flow rate, and controlling the driver to drive the flow regulator based on the comparison result, thereby enabling the gas flow rate sensed by the hot film anemometer to be maintained at the predetermined gas flow rate.

10. A gas appliance, comprising:

a burner, adapted to burn gas to generate flames;

a gas valve, including a valve body, a flow regulator, a hot film anemometer, and a driver, wherein the valve body includes an air inlet, an air outlet, an inlet passage communicating with the air inlet, an outlet passage communicating with the air outlet, and an opening disposed between the inlet passage and the outlet passage; the air inlet is adapted to be connected to a gas source, and the air outlet communicates with the burner; wherein the valve body comprises a main body and a tube detachably connected to the main body, the tube comprises a threaded tube and an outer tube which are connected to each other; the threaded tube is engaged with an internal thread of a connecting passage of the main body; the tube comprises the outlet passage and the air outlet, and a recess is recessed into an inner wall of the tube; the flow regulator is movably disposed at the opening of the valve body, wherein the flow regulator is driven to change an opening degree of the opening; the hot film anemometer is disposed in the recess of the tube, wherein the hot film anemometer includes a probe which includes a hot film resistor exposed to the outlet passage of the tube to sense a gas flow rate passing through the outlet passage of the tube; wherein a section of a signal wire connected to the hot film anemometer is disposed in the tube, and an end of the signal wire which is not connected to the hot film anemometer extends in a direction away from the outlet passage; the driver is disposed in the valve body and connected to the flow regulator, wherein the driver is adapted to receive a control signal to drive the flow regulator to move; and a control device, being electronically connected to the hot film anemometer and the driver, wherein the control device is adapted to control the driver to drive the flow regulator by outputting the control signal according to a predetermined gas flow rate, thereby enabling the gas flow rate sensed by the hot film anemometer to be maintained at the predetermined gas flow rate;

wherein the hot film anemometer does not protrude out of the inner wall of the tube.

11. The gas appliance of claim 10, wherein the hot film anemometer further includes a substrate, and the hot film resistor is disposed on the substrate.

12. The gas appliance of claim 10, further comprising a flow guiding member disposed in the outlet passage; the probe of the hot film anemometer is disposed between the flow guiding member and the air outlet.

13. The gas appliance of claim 12, wherein the flow guiding member further includes a plurality of sub-passages.

14. The gas appliance of claim 12, wherein the outlet passage further includes a first section and a second section, wherein the first section is between the flow guiding member and the second section, and the second section is between the first section and the air outlet; the probe of the hot film anemometer is disposed in the second section.

15. The gas appliance of claim 14, wherein the first section and the second section of the outlet passage have identical internal diameters.

16. The gas appliance of claim 14, wherein the outer tube includes at least a part of the second section and is disposed outside of the main body; the hot film anemometer is disposed in the outer tube.

17. The gas appliance of claim 16, wherein the recess is located at the outer tube and is recessed into a wall of the second section.

* * * * *